United States Patent [19]

Holl et al.

[11] 3,933,687

[45] Jan. 20, 1976

[54] METHOD OF MANUFACTURING CARBON BRUSHES FOR ELECTRICAL MACHINES

[75] Inventors: Walter Holl; Martin Scholpp, both of Stuttgart, Germany

[73] Assignee: Robert Bosch G.m.b.H., Stuttgart, Germany

[22] Filed: Jan. 23, 1974

[21] Appl. No.: 435,959

[30] Foreign Application Priority Data

Feb. 28, 1973 Germany ..... 2309834

[52] U.S. Cl. ..... 252/511; 252/503; 252/510; 264/104; 264/105

[51] Int. Cl.[2] ..... H01B 1/06

[58] Field of Search ..... 252/511, 510, 503; 264/104, 105

[56] References Cited

UNITED STATES PATENTS

| | | | |
|---|---|---|---|
| 2,224,724 | 12/1940 | Elsey | 252/511 X |
| 3,697,450 | 10/1972 | Takenaka et al. | 252/511 |
| 3,716,609 | 2/1973 | Trocciola et al. | 264/111 |

*Primary Examiner*—Benjamin R. Padgett
*Assistant Examiner*—E. Suzanne Parr
*Attorney, Agent, or Firm*—William R. Woodward

[57] ABSTRACT

A binder consisting of an aromatic polymeric material in which aryl groups are connected together by single-bond linkages over one or more atoms of carbon, sulfur, oxygen, nitrogen, phosphorus or silicon, preferably polyphenylene-sulfide, is mixed with carbon particles, with or without the addition of copper powder and the mixture is then pressed in a mold, removed from the mold, and sintered at a temperature of 300–500°C, preferably about 350°C for about an hour. Even without the presence of metal powder such brushes have qualities comparable to brushes cut from carbon plate material and conventional copper-containing brushes, and have substantially longer life than the former.

5 Claims, No Drawings

METHOD OF MANUFACTURING CARBON BRUSHES FOR ELECTRICAL MACHINES

The invention relates to a process for manufacturing carbon brushes made of a mixture of carbon and a binder, with or without admixture of a metal powder, for use in electrical machines.

Carbon brushes are made in a particularly economical manner by mixing component materials — graphite, coke, metal powder and binder — in the desired proportions, compressing the mixed powder or granular material in a mold to its final shape and then producing cohesion of the components, including curing or coking of the binder, by a suitable thermal treatment. There are advantages of convenience if the compression in the mold can be carried out at room temperature and if the electrical connection lead can be pressed into the article at the same time.

The following qualities are desired in a binder for carbon brushes:

1. The material should be available in powder form with good pouring qualities.
2. Above a definite and sufficiently high melting point, it should quickly soften and then have as little viscosity as possible.
3. In the melted state it should wet both the carbon and the metal powder very well, a quality that leads to high mechanical stability and low binder content requirement.
4. It should cure by cross-linking readily when heated in air.
5. It should provide the brush with a favorable abrasion behavior by promoting the formation of a patina on the collector ring or slip ring of the machine in which it is used.

All five of these quality requirements should be fulfilled as far as possible, the second, third and fifth items being of greater weight.

The binders heretofore used, which are pitch, phenolic resins and lead, do not fulfill all of the above-named requirements at the same time. Consequently, in order to obtain sufficient mechanical stability a relatively large binder content is necessary, as the result of which the electrical and thermal conductivity is unfavorably affected. In consequence metal-free carbon brushes can be made in this way only with poor quality, since these carbon materials cannot be produced with sufficient mechanical stability. For this type of brush, accordingly, it is necessary to turn to plate carbons that are produced by coking and graphitizing of plates, followed by machining the desired brush shape, followed by soldering on of the lead wire. This technology is substantially more expensive that the pressing of a powder into the final shape.

It is an object of the present invention to provide an economic method for making carbon brushes, especially also metal-free carbon brushes, that measure up to or even exceed the qualities of the heretofore known brushes, particularly those made out of plate carbon.

SUBJECT MATTER OF THE PRESENT INVENTION:

Briefly, in the initial step of mixing the component materials there is used a binder of the class of singlebonded aromatic polymers, i.e. polymers in which aromatic ring groups are connected to each other directly through a C—C bond or through a heteroatom or a heteroatom group. This group of materials is more particularly described in Hochtemperaturbestaendige Kunststoffe [Synthetic Materials Stable at High Temperatures] by E. Behr (Munich 1969) pp. 47ff.

The above-named class of materials fulfills all the requirements previously counted off: they have good pouring qualities as powders at room temperature; the melting point lies sufficiently high; they wet carbon very well because of their aromatic content, and they are generally easy to cure.

Particularly preferred are the polyarylsulfides of the general formula:

...Ar—S—Ar—S—Ar...

in which Ar designates an aromatic ring system, the hydrogen atoms of which may be partly substituted by alkyl residues. Among this preferred group of compounds polyphenylenesulfide, available under the trade name Ryton from Phillips Petroleum Co., has been found particularly effective. This polyphenylenesulfide has the following formula:

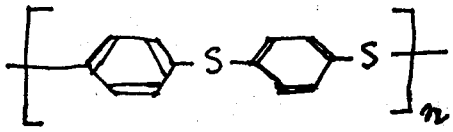

The above-named binders are mixed with the carbon in a quantity amounting to from 0.5 to 50 parts by weight for every 100 parts by weight of carbon in the initial mixture, and preferably from 3 to 10 parts by weight per 100 parts by weight of carbon. The following example illustrates more particularly the practice of the invention.

EXAMPLE 1.

100 parts by weight of natural graphite are thoroughly mixed with 10 parts by weight of polyphenylenesulfide in finely ground form and the mixture is then compressed in a compression mold, the inside shape of which corresponds to the brush to be manufactured. A pressure of 4 metric tons per $cm^2$ is applied. The pressed blank is removed from the mold, after which it is sintered for about one hour at a temperature between 300°C and 100°C, preferably about 350°C, in a protective gas atmosphere, e.g., nitrogen or city gas, a mixture consisting principally of hydrogen, methane and carbon monoxide. After cooling, the manufacture of the carbon brush is complete. Instead of 100 parts of natural graphite there could also be used 42 parts by weight of natural graphite and 55 parts by weight of copper in powdered form, in which case a brush with the corresponding copper content is obtained instead of a metal-free brush. The manufacturing conditions are the same for the copper-bearing brush as those already described above.

In the following table, the properties of a carbon brush made in accordance with the process of the invention are compared to those of a copper-bearing brush made without a binder and also with a brush machined out of a mineral carbon plate.

TABLE I

Comparison of Properties of a Conventional Copper Item Containing Carbon Brush, a Metal-Free Carbon Brush Made According to the Invention and a Metal-Free Carbon Brush Machined Out of a Plate.

| Type | Cu-Containing Brush | Nat. Graphite with Polyphenylenesulfide | Natural Graphite |
|---|---|---|---|
| Manufacturing Process | Pressed in Mold | Pressed in Mold | Cut from Plates |
| spec. elec. resistance (Ω cm) | 100–1000 | 1800–3000 | 3000–6000 |
| Hardness (HRc 10/40) | 50–70 | 60–70 | 60–80 |
| Breakdown Load (kp) (acc. to PVA 6742 and 10 mm vist.) | 15–25 | 30–40 | 9–25 |
| Life (hrs.) | 1600 | 2300 | 2000 |
| Voltage Drop (V) | 0.2–0.4 | 0.2–0.3 | 1.0–2.0 |

The comparisons show that in principle carbon brushes made under the same manufacturing conditions with polyphenylenesulfide are at least as good as the copper-bearing brushes and clearly superior in service life. A particular advantage may be observed from the fact that in spite of the high specific electrical resistance of the carbon materials made according to the invention, the absolute voltage drop lies in the same order of magnitude as in the case of the copper-bearing brushes. This points to an excellent patina formation with good stabilization of the patina and explains the good operating qualaties. Compared to the carbon brush machined out of plate material, the manufacturing process for which, as already mentioned above, is relatively expensive, the advantage of the carbon articles produced according to the invention lies particularly in the fact that their cost of production and price is only half of that of the carbon brushes machined out of plates.

The manufacturing method of the invention, accordingly makes it possible to manufacture carbon brushes at exceptionally favorable costs that in their properties match the heretofore conventional brushes in all respects or even excel thereover.

The term "heteroatom" with reference to an atom other than carbon commonly entering into organic compounds as an intermediate atom linking two carbon atoms, include atoms of the following elements: sulfur, oxygen, nitrogen, phosphorus and silicon.

Brushes containing a binder in which aryl groups are connected together by single bond linkages over one to four atoms of not more than two of the elements mentioned above are sintered at a temperature between 300°C and 500°C.

What is claimed is:

1. Method of manufacturing carbon brushes for use in electrical machinery, comprising the steps of:
   mixing carbon particles together with particles of a binder,
   pressing the mixture in a mold to form a brush blank,
   removing the pressed blank from the mold and sintering it at a temperature between 300°C and 500°C,
   said binder being pressed in an amount which is between 0.5 and 50% by weight of the amount of carbon in said mixture, said binder consisting of a material that is a readily flowing and chemically stable liquid at the temperature of sintering, and is selected from the group consisting of polyaryl sulfides and polyaryl ethers.

2. Method of manufacturing carbon brushes as defined in claim 1, in which said binder is present in said mixture in an amount not less than 3% and not more than 10% of the amount of carbon.

3. Method of manufacturing carbon brushes as defined in claim 1, in which in the step of mixing carbon powder and a binder powder copper powder is also mixed.

4. Method of manufacturing carbon brushes as defined in claim 1, in which the binder mixed in the step of mixing carbon powder and a binder powder is a polyarylsulfide of the general formula $$\ldots Ar-S-Ar-S-Ar\ldots$$

in which formula Ar represents an aromatic ring of which the hydrogen atoms, to the extent substituted, are substituted by alkyl radicals.

5. Method of manufacturing carbon brushes as defined in claim 1, in which said binder is polyphenylenesulfide.

* * * * *